US006571705B2

(12) United States Patent
Lesti

(10) Patent No.: US 6,571,705 B2
(45) Date of Patent: Jun. 3, 2003

(54) DOCTOR ROLLER APPARATUS

(75) Inventor: Harald Lesti, Aichach (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/875,600

(22) Filed: Jun. 6, 2001

(65) Prior Publication Data

US 2001/0050008 A1 Dec. 13, 2001

(30) Foreign Application Priority Data

Jun. 8, 2000 (DE) ..... 100 28 494

(51) Int. Cl.[7] ..... B41F 31/02
(52) U.S. Cl. ..... 101/366; 101/350.6
(58) Field of Search ..... 101/147, 148, 101/335, 348, 350.6, 350.3, 365, 366

(56) References Cited

U.S. PATENT DOCUMENTS

| | | | | |
|---|---|---|---|---|
| 2,707,434 A | | 5/1955 | Morhardt | |
| 3,533,833 A | * | 10/1970 | Takahashi et al. | 117/102 |
| 3,561,360 A | | 2/1971 | Branfield | 101/350 |
| 3,701,335 A | * | 10/1972 | Barnscheidt | 101/120 |
| 5,103,726 A | * | 4/1992 | Wieland | 101/350.3 |
| 5,315,930 A | * | 5/1994 | Niemiro | 101/366 |
| 5,372,644 A | | 12/1994 | Kochsmeier | 118/46 |
| 5,735,208 A | | 4/1998 | Hummel et al. | 101/329 |

FOREIGN PATENT DOCUMENTS

| | | |
|---|---|---|
| DD | 23 050 | 4/1962 |

* cited by examiner

*Primary Examiner*—Ren Yan
(74) *Attorney, Agent, or Firm*—Cohen, Pontani, Lieberman & Pavane

(57) ABSTRACT

Apparatus for the metered coating of a printing machine roller with a liquid application medium, in particular for the metered coating of an ink applicator roller with printing ink, containing at least one doctor roller placed with its working surface onto the printing machine roller and carried by a doctor roller bed. The doctor roller is slide-mounted on its working surface by means of at least one sliding surface formed on the doctor roller bed. The application medium can be fed to or discharged from the surface of the printing machine roller by rotation of the doctor roller, through a clearance between the sliding surface and the working surface of the doctor roller. A pressure-regulatable valve for regulating the pressure prevailing in the clearance is arranged between a pressure source for the application medium and the clearance.

11 Claims, 2 Drawing Sheets

DOCTOR ROLLER APPARATUS

BACKGROUND OF THE INVENTION

1. Field of the Invention

The invention relates to a doctor roller apparatus for the metered coating of a printing machine roller with a liquid application medium, in particular for coating an ink applicator roller with printing ink, of the type having at least one doctor roller supported by a doctor roller bed and placed with its working surface against the printing machine roller.

2. Description of the Related Art

Such a doctor roller apparatus is known from U.S. Pat. No. 5,372,644, in which the ink applicator roller is connected via a nip to a transfer roller, the surface of which dips into a fountain filled with application medium. The fountain is sealed off relative to the transfer roller by means of a barrier doctor blade and a doctor roller. The doctor roller does not cause the fountain to be sealed off completely, since it has an engraving through which a metered quantity of the application medium can flow, this quantity remaining on the surface of the transfer roller. This quantity of application medium defined by the respective engraving is then transferred from the transfer roller onto the applicator roller.

To vary the metering, a different doctor roller with an appropriately adapted engraving must be used, this being a disadvantage in view of the associated outlay in terms of production and stockkeeping.

SUMMARY OF THE INVENTION

By contrast, the object of the present invention is to provide an apparatus of the type mentioned in the introduction, by means of which a self-regulating supply of the printing machine roller with application means and rapid adaptation to changed metering conditions are possible. Furthermore, the doctor roller apparatus according to the invention is to be capable of being produced cost-effectively.

This object is achieved by an apparatus having a pressure source which supplies the application medium to a clearance between the doctor roller and the doctor roller bed, and a pressure regulating valve between the source and the doctor roller.

The metering of application medium on the printing machine roller, in particular of printing ink on an ink applicator roller, takes place by means of the doctor roller apparatus according to the invention in a self-regulating manner. For example, when the printing ink requirement on the ink applicator roller is very low, because the latter has a high proportion of ink-repelling surfaces, only a small part of the application medium transported by the doctor roller remains adhering to the ink applicator roller, while the rest is conveyed back into the clearance in which a higher pressure is then established. This pressure prevails on the outlet side at the pressure-regulating valve which thereupon restricts the further inflow of printing ink in order to lower the pressure in the clearance. As a result of the sliding mounting of the doctor roller due to the printing ink forming a hydrodynamic lubricating film in the clearance, a kind of consumption lubrication occurs, in which excess printing ink is automatically conveyed back into the clearance by the doctor roller. This results in a closed system with a low-loss ink circulation and the use of only a small amount of solvent. The application, metering and smoothing of the ink on the ink applicator roller are carried out advantageously by means of a single unit.

On account of the double function of the clearance which gives rise, on the one hand, to a sliding mounting for the doctor roller and, on the other hand, to a transport duct for the printing ink, the doctor roller apparatus according to the invention has an extremely compact build. A short inking zone is consequently obtained, with the result that the outlay in cleaning terms is reduced. Since there is in the clearance a sliding film consisting of printing ink, the mounting of the doctor roller has some elasticity, so that axial errors, unavoidable in practice, between the doctor roller and the ink applicator roller can be compensated. Thus, advantageously, a surface pressure which is constant over the axial length can be achieved between the doctor roller and the ink applicator roller. Finally, the doctor roller apparatus according to the invention can be used for different circumferences and types of printing machine rollers.

According to a preferred embodiment, the working surface of the doctor roller is provided on its ends with helical conveying grooves oriented so that, when the doctor roller is driven, printing ink located at the lateral ends of the clearance can be conveyed to the middle of the doctor roller. Application medium is thereby prevented from escaping laterally from the clearance.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
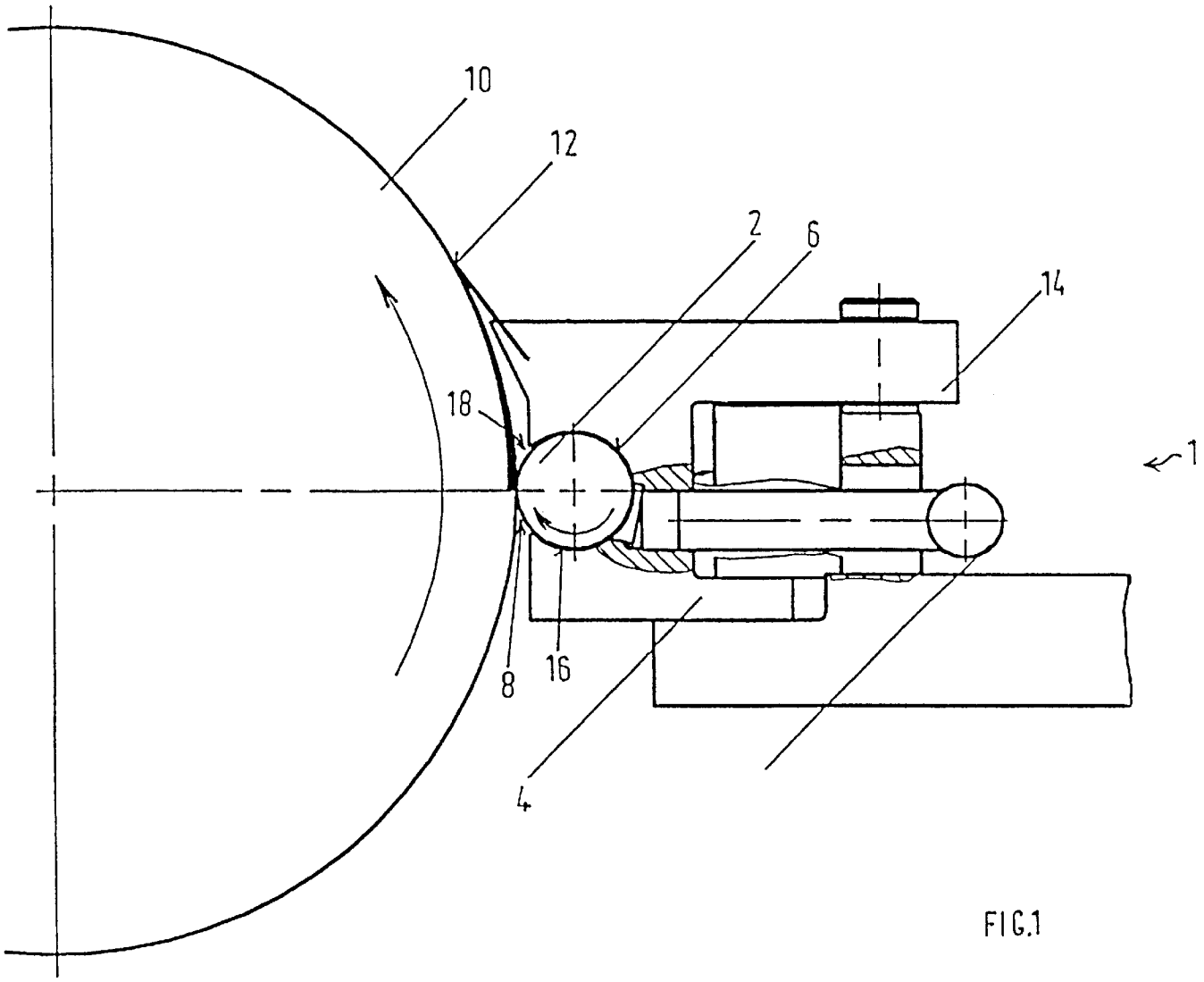
FIG. 1 is a side view of a preferred exemplary embodiment of a doctor roller apparatus according to the invention placed onto an ink applicator roller of a printing machine.

In FIG. 1, a doctor roller apparatus 1 contains a doctor roller 2 which is carried by a doctor roller bed 4 and is pressed with its working surface 6 through a nip 8 onto an ink applicator roller 10 in the inking unit of a printing machine. The ink applicator roller 10, in turn, inks a printing forme, not illustrated for reasons of scale, which is tension-mounted on a forme cylinder. In order to achieve a defined pressing force of the doctor roller 2 on the surface 12 of the ink applicator roller 10, the doctor roller bed 4 is prestressed in the direction of the ink applicator roller 10 by means of one or more diaphragm-type air cylinders 14. The doctor roller 2 is assigned a drive, not illustrated here, by means of which it can be set in rotational movement at an adjustable speed and with an adjustable direction of rotation relative to the ink applicator roller 10.

Figure 3:
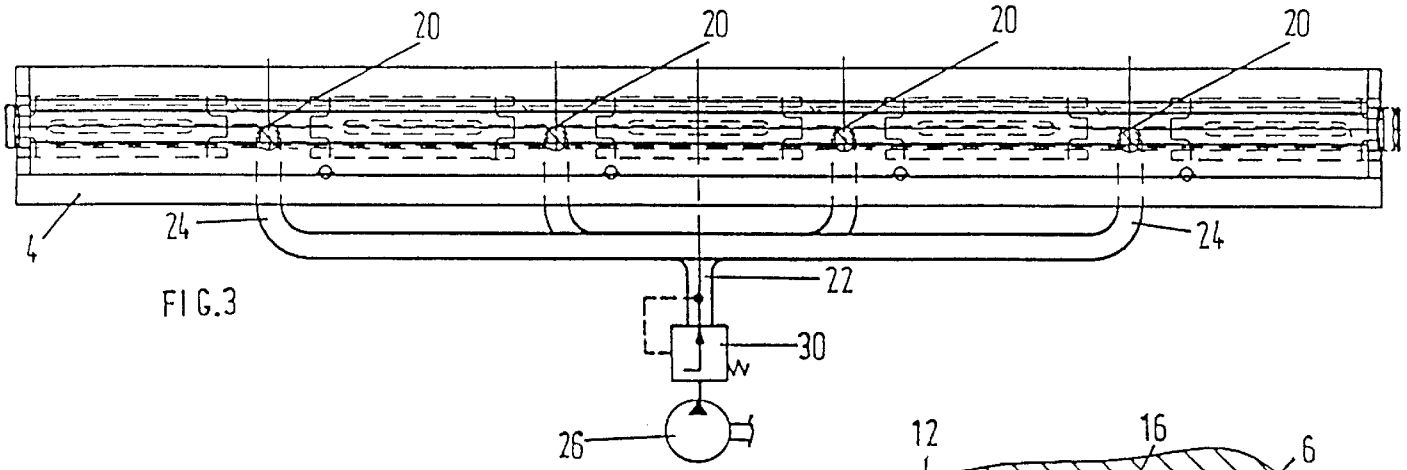
FIG. 3 shows a top view of the doctor roller apparatus of FIG. 1.

The doctor roller 2 is mounted, on its working surface 6, by means of a cylindrical sliding surface 16 formed in the doctor roller bed 4 and projects radially beyond an approximately rectangular aperture 18 formed in the sliding surface 16 and is in contact with the surface 12 of the ink applicator roller 10 which extends parallel to the aperture. On the opposite side facing away from the ink applicator roller 10, the sliding surface 16 has ink bores 20 which are arranged at a distance from one another along the length of the doctor roller bed 4. An ink tube 24 branching off from a central ink distributor tube 22, as shown in FIG. 3, issues into each bore 20. Pressurized printing ink is pumped into the central ink distributor manifold 22 by means of a pump 26 and passes via the ink tubes 24 and the ink bores 20 into a clearance 28 present between the sliding surface 16 and the working surface 6 of the doctor roller 2. Furthermore, the ink distributor manifold 22 has arranged in it a pressure-regulating valve 30 which keeps the pressure in the downstream clearance 28 constant, irrespective of the feed pressure generated by the pump 26, as a result of the throttling or opening of the inflow.

When the doctor roller 2 rotates relative to the sliding surface 16 in the direction indicated by the arrow, the printing ink flushed in through the ink bores 20 is entrained as a result of its adhesive and viscous properties and is pressed into the clearance 28. The doctor roller 2 is slide-mounted within the sliding surface 16 of the doctor roller bed 4 by means of a supporting hydrodynamic lubricating pressure generated in the clearance 28.

The clearance height resulting from half the difference in diameter between the outside diameter of the doctor roller 2 and the inside diameter of the sliding surface 16 is, in this case, such that the clearance 28 can form a transport duct for the printing ink on the path between the ink bores 20 and the aperture 18 directed towards the ink applicator roller 10. On account of adhesion to the effective surface 6 of the doctor roller 2, the printing ink located in the clearance 28 is then transported towards the aperture 18. Finally, in the nip 8, the ink passes as a thin ink film onto the surface 12 of the ink applicator roller 10 which executes in the nip 8 a circumferential movement in the same direction as the doctor roller 2, as can best be seen from the enlarged view of FIG. 2. The clearance 28 thus serves as an interspace in which hydrodynamic supporting pressure necessary for the sliding mounting of the doctor roller 2 can be generated, and also forms the transport duct for supplying ink to and removing it from the ink applicator roller 10. Since the clearance 28 always contains a particular ink volume, it also constitutes a chamber-like reservoir, downstream of the pressure-regulating valves 30, for the printing ink.

If, for example, the ink requirement on the ink applicator roller 10 is low because there is a high proportion of ink-repelling surfaces on the latter, only a small part of the printing ink transported by the doctor roller 2 remains adhering to the surface 12 of the ink applicator roller 10, whilst the rest is conveyed back into the clearance 28, in which a higher pressure is then established. This pressure counteracts the feed pressure generated in the ink distributor manifold 22 by the pump 26 and prevails on the outlet side at the pressure-regulating valve 30 which thereupon throttles the further inflow of printing ink in order to lower the pressure in the clearance 28 to the desired constant pressure.

So that the ink layer located on the doctor roller 2 and running back into the clearance 28 after passing through the orifice is not stripped off at an entry 32 of the doctor roller bed 4, the clearance 28 does not narrow abruptly at the entry, but in a funnel-shaped manner, as seen in the direction of rotation of the doctor roller 2.

If there is a greater ink requirement on the ink applicator roller 10, more printing ink is transferred from the doctor roller 2 onto the ink applicator roller 10 at the nip 8 and the pressure in the clearance 28 falls. The upstream pressure-regulating valve 30 will react correspondingly by its flow cross section being widened, in order to allow more printing ink to flow through and to increase the pressure in the clearance 28 to the desired constant pressure.

Depending on the ink requirement, the quantity of printing ink transferred onto the surface 12 of the ink applicator roller 10 is therefore adapted automatically, without further settings having to be carried out. If, for example, the ink applicator roller 10 inks the printing forme tension-mounted on the forme cylinder, a residual relief is left behind with ink gaps on the ink applicator roller 10. Consequently, a further transport of printing ink is necessary, in order to ink in the ink gaps anew. The pressure-regulating valve 30 then sets the ink quantity to be conveyed further in accordance with the pressure conditions which are established in the clearance 28 as a result of the ink requirement on the ink applicator roller 10.

In the case of a change in the nip conditions, for example when a higher placement force of the doctor roller 2 on the ink applicator roller 10 is generated as a result of an increase in pressure in the diaphragm-type air cylinders 14, the floating mounting of the doctor roller 2 yields elastically and the pressure in the clearance 28 initially rises, whereupon, however, the pressure-regulating valve 30 lowers the pressure in the clearance 28 by a reduction in the ink feed flow. The printing ink is consequently metered as a result of the force equilibrium established between the pressing force with which the doctor roller 2 is pressed against the ink applicator roller 10 and the bearing force which counteracts this and which is established by the ink pressure prevailing in the clearance 28.

The metering of the ink film on the ink applicator roller 10 is also influenced, inter alia, by the following parameters: the relative speed between the doctor roller 2 and the ink applicator roller 10 in the nip 8, the nip ratio (arc length of the contact surfaces in the nip 8 between the effective surface 6 of the doctor roller 2 and the surface 12 of the ink applicator roller 10), the pressing force of the doctor roller 2 against the ink applicator roller 10, the capillary action taking place due to the respective clearance height, the geometry and nature of the surfaces 6, 12 of the ink applicator roller 10 and of the doctor roller 2 and also the Reynold's number of the flow in the clearance 28. The influence of these variables on the ink supply on the ink applicator roller 10 can be determined empirically and represented by corresponding process characteristic curves. The volume of the clearance 28 and, in particular, its clear height exert a great influence on the thickness of the ink film on the ink applicator roller 10, since, in the case of a larger clearance 28, a larger ink volume can also be conveyed through it.

Figure 2:
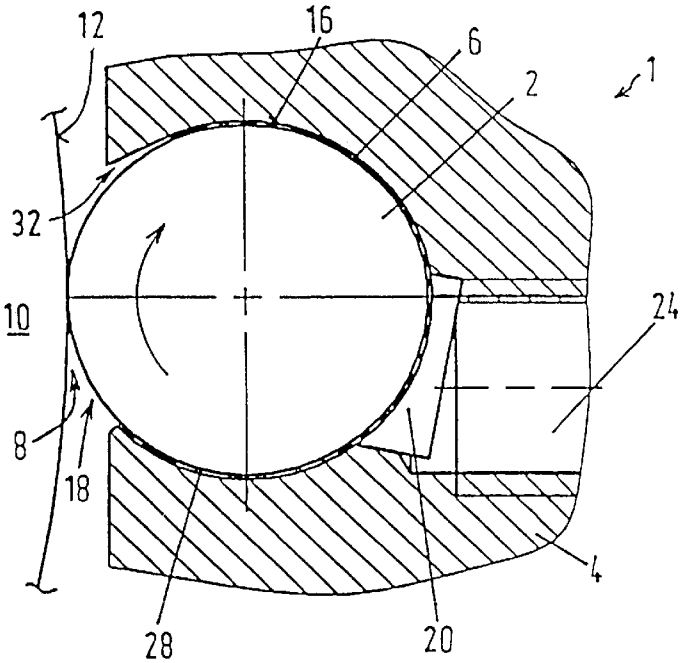
FIG. 2 shows an enlarged cross-sectional illustration of a detail of FIG. 1.
Figure 4:
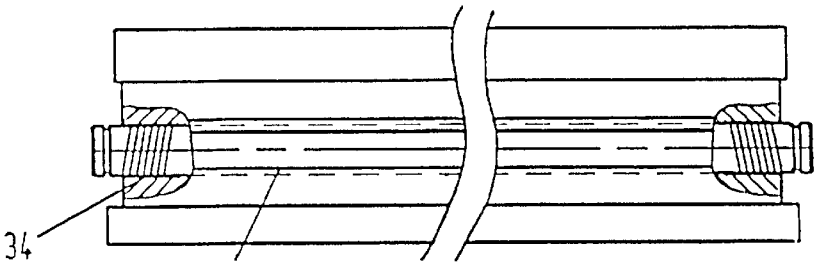
FIG. 4 shows a front view of the doctor roller apparatus of FIG. 1.

As shown in FIG. 4, the doctor roller 2 is provided at each end of the working surface with helical conveying grooves 34, the direction of rotation of which is oriented such that, when the doctor roller 2 is driven in the direction indicated by the arrow in FIG. 2, printing ink located at the lateral ends of the clearance 28 is conveyed to the middle of the doctor roller 2. This prevents the situation where printing ink can escape laterally from the clearance 28 and the pressure in the clearance 28 decreases as a result.

Reversing the process described above, the doctor roller apparatus 1 according to the invention may also be used to remove ghosting on the ink applicator roller 10. This is achieved by the direction of rotation of the doctor roller 2 being reversed, so that the circumferential speeds of the doctor roller 2 and ink applicator roller 10 in the nip 8 are opposite to one another. In this case, due to the opposite rotational movement of the doctor roller 2, the ink layer responsible for the ghosting effects is wiped off from the ink applicator roller 10 and conveyed by the doctor roller 2 into the clearance 28, from where it can be pumped away as a result of the action of the pump 26 which then exerts a suction effect. Self-cleaning then occurs due to the doctor roller 2 being driven constantly opposite to the direction of run of the ink applicator roller 10. The doctor roller apparatus 1 may also serve for smoothing and equalizing the ink layer present on the ink applicator roller 10.

By means of a series connection of a plurality of doctor rollers 2, the number of ink-transferring nips 8 is increased, thus leading to a better distribution and homogenization of the printing ink. Finally, the doctor roller apparatus 1 according to the invention may be of the traversing type, that is to say it is capable of being moved back and forth in an oscillating manner along the surface 12 of the ink applicator roller 10 and parallel to this.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. Apparatus for the metered coating of a printing machine roller with a liquid application medium, said apparatus comprising a doctor roller bed having a sliding surface, a doctor roller having a working surface supported on said sliding surface with a clearance between said working surface and said sliding surface, said doctor roller being arranged to feed liquid application medium to the printing machine roller via said clearance and to discharge liquid application medium from the printing machine roller via said clearance as said doctor roller is rotated, a pressure source for supplying a flow of liquid application medium to said clearance under pressure, and a pressure regulating valve between said pressure source and said doctor roller for regulating the pressure of the application medium in the clearance, whereby said application medium which is discharged from said printing roller contributes to said pressure in said clearance.

2. Apparatus as in claim 1 wherein said sliding surface comprises a substantially rectangular aperture, said doctor roller extending radially beyond said rectangular aperture for parallel contact with said printing machine roller, said sliding surface further comprising a plurality of ink bores facing away from said aperture, said ink bores being spaced apart along the length of said doctor roller, said apparatus further comprising an ink distribution manifold between said pressure regulating valve and said ink bores.

3. Apparatus as in claim 2 wherein said pressure source comprises a pump for pumping ink into said manifold via said pressure regulating valve.

4. Apparatus as in claim 3 wherein said pressure regulating valve can regulate the pressure of said ink in said clearance regardless of the pressure generated by said pump.

5. Apparatus as in claim 4 wherein said clearance comprises a duct for transporting printing ink from the ink bores to the aperture, and a duct for transporting ink from said aperture to said ink bores.

6. Apparatus as in claim 3 wherein said pump is reversible so that said pump can pump application medium away from said clearance in order to remove ink from said printing machine roller via said manifold.

7. Apparatus as in claim 1 further comprising a drive for driving said doctor roller at an adjustable speed in an adjustable direction of rotation relative to the printing machine roller, whereby the quantity of application medium transferred to said printing machine roller can be metered as a function of the speed and direction of rotation of the doctor roller relative to the printing machine roller.

8. Apparatus as in claim 1 further comprising a diaphragm-type air cylinder for urging said doctor roller against said printing machine roller.

9. Apparatus as in claim 1 wherein said working surface of said doctor roller has axially opposed ends and a middle portion therebetween, said axially opposed ends being provided with helical conveying grooves which are oriented to convey application medium from said ends toward said middle portion when said doctor roller is rotated.

10. Apparatus as in claim 1 further comprising a funnel shaped entry into said clearance between said doctor roller bed and said doctor roller where said application medium is discharged from said printing machine roller.

11. Apparatus as in claim 1 wherein said pressure regulating valve maintains a constant pressure in said clearance by regulating said flow.

* * * * *